US012104595B2

(12) United States Patent
Jäggle et al.

(10) Patent No.: US 12,104,595 B2
(45) Date of Patent: Oct. 1, 2024

(54) PRESSURE POCKETS ON THE HOLLOW WHEEL

(71) Applicant: Schwäbische Hüttenwerke Automotive GmbH, Aalen (DE)

(72) Inventors: Gerd Jäggle, Ertingen (DE); Bernd Schobel, Allmannsweiler (DE); Holger Braasch, Pfullendorf (DE); Thomas Wahl, Ertingen (DE); Johannes Gnann, Bad Schussenried (DE); Michael Ehringer, Bad Schussenried (DE)

(73) Assignee: SCHWÄBISCHE HÜTTENWERKE AUTOMOTIVE GMBH, Aalen (DE)

( * ) Notice: Subject to any disclaimer, the term of this patent is extended or adjusted under 35 U.S.C. 154(b) by 0 days.

(21) Appl. No.: 17/983,669

(22) Filed: Nov. 9, 2022

(65) Prior Publication Data

US 2023/0141341 A1 May 11, 2023

(30) Foreign Application Priority Data

Nov. 11, 2021 (DE) ..... 10 2021 129 445.2

(51) Int. Cl.
*F04C 2/08* (2006.01)
*F04C 2/10* (2006.01)
*F04C 15/00* (2006.01)

(52) U.S. Cl.
CPC ..... *F04C 2/082* (2013.01); *F04C 2/103* (2013.01); *F04C 15/0026* (2013.01)

(58) Field of Classification Search
CPC ..... F04C 2/082; F04C 2/084; F04C 2/086; F04C 2/088; F04C 2/103; F04C 15/0023; F04C 15/0026; F01C 1/103
See application file for complete search history.

(56) References Cited

U.S. PATENT DOCUMENTS

RE27,228 E * 11/1971 Brundage ..... F04C 15/0042 418/71
3,680,989 A * 8/1972 Brundage ..... F04C 15/0042 418/79

(Continued)

FOREIGN PATENT DOCUMENTS

DE 102007055911 A1 7/2008
DE 102011083425 A1 3/2013

(Continued)

OTHER PUBLICATIONS

JP05099117A—Hosono—Internal Gear Type Hydraulic Rotary Device—Apr. 20, 1993—the English Machine Translation (Year: 1993).*

(Continued)

*Primary Examiner* — Theresa Trieu
(74) *Attorney, Agent, or Firm* — BUCHANAN INGERSOLL & ROONEY PC

(57) ABSTRACT

A rotary pump includes a housing featuring a delivery space which the housing surrounds and axially delineates on the end sides; an inner rotor rotatable in the delivery space; an outer rotor rotatable about a pump rotational axis in the delivery space and forming delivery cells with the inner rotor; and a circumferential bearing wall which mounts and surrounds the outer rotor rotatably about the pump rotation axis in radial sliding contact. The circumferential bearing wall includes multiple blind pockets which are radially open towards the outer rotor and/or the outer rotor includes multiple blind pockets which are radially open towards the circumferential bearing wall.

23 Claims, 7 Drawing Sheets

(56) References Cited

U.S. PATENT DOCUMENTS

| | | | | | |
|---|---|---|---|---|---|
| 5,472,329 | A * | 12/1995 | Maynard | ..... | F04C 2/102<br>418/152 |
| 2019/0277171 | A1 * | 9/2019 | Jäggle | ..... | F04C 14/06 |

FOREIGN PATENT DOCUMENTS

| | | | | | |
|---|---|---|---|---|---|
| DE | 102018105121 | A1 | | 9/2019 | |
| DE | 102019001466 | A1 | | 9/2020 | |
| GB | 2085969 | A | * | 5/1982 | ..... F04C 2/084 |
| JP | 63195390 | A | | 8/1988 | |
| JP | 0419375 | A | | 1/1992 | |
| JP | 05099117 | A | * | 4/1993 | ..... F04C 2/102 |
| JP | 2007023975 | A | | 2/2007 | |
| JP | 2013199850 | A | | 10/2013 | |
| JP | 2018123793 | A | | 8/2018 | |

OTHER PUBLICATIONS

German Search Report issued in German Patent Application No. 10 2021 129 445.2 mailed Aug. 1, 2022, 15 pages, with English translation.

Extended European Search Report for European Application No. 22 205 885.1, dated Apr. 4, 2023 with translation, 12 pages.

* cited by examiner

PRESSURE POCKETS ON THE HOLLOW WHEEL

CROSS REFERENCE TO RELATED APPLICATIONS

This application claims benefit of priority to German Patent Application No. 10 2021 129 445.2, filed Nov. 11, 2021. The contents of this application is incorporated herein by reference.

FIELD OF THE INVENTION

The invention relates to a rotary pump for delivering a fluid; the rotary pump relates in particular to an electrically driven rotary pump. The rotary pump is preferably an electric rotary pump for delivering oil in order to supply a machine assembly. The rotary pump is in particular an oil pump for a motor vehicle for supplying oil, in particular lubricating oil, to an engine and/or a transmission. The rotary pump comprises a housing featuring a delivery space which the housing surrounds and axially delineates on the end sides. The delivery space comprises at least one inlet for the fluid on a low-pressure side of the rotary pump and an outlet for the fluid on the high-pressure side of the rotary pump.

A rotatable inner rotor is formed in the delivery space of the rotary pump, as is an outer rotor which can be rotated about a pump rotational axis and which forms delivery cells with the inner rotor. The pump rotational axis of the inner rotor is formed eccentrically with respect to the pump rotational axis of the outer rotor. A circumferential bearing wall formed by the housing or arranged in the housing surrounds the outer rotor on the radially outer side and rotatably mounts it in a sliding contact.

BACKGROUND OF THE INVENTION

In practice, rotary pumps comprising an outer rotor mounted on the radially outer side exhibit starting problems, in particular after long downtimes, which are caused in particular by the friction between the outer circumferential surface of the outer rotor and the inner circumferential surface of the circumferential bearing wall. The adhesion and/or friction forces between the outer circumferential surface of the inner rotor and the inner circumferential surface of the circumferential bearing wall can be so great that no fluid or only very little fluid is initially delivered when the pump starts up. This ca result in damage to the pump and/or the assemblies to which the fluid delivered by the pump is to be supplied.

In addition to the starting problems, the fluid in the lubricating gap between the outer circumferential surface of the outer rotor and the inner circumferential surface of the circumferential bearing wall can generate a viscous friction, in particular at high rotational speeds, which exerts a negative effect on the efficiency of the rotary pump. Since the viscous friction results in particular from the fluid adhering to the stationary inner circumferential surface of the circumferential bearing wall and the moving outer circumferential wall of the outer rotor and from the resulting shearing of the fluid, the viscous friction forces can increase with the rotational speed of the pump, whereby the required drive output of the rotary pump can increase disproportionately with respect to the rotational speed.

In conventional rotary pumps comprising an outer rotor mounted on the radially outer side, both the outer circumferential surface of the outer rotor and the inner circumferential surface of the circumferential bearing wall are therefore additionally machined in order to achieve a high surface quality and minimize adhesion and/or friction forces. Such processing steps require a high level of precision so that tolerances are observed and the lubricating gap between the outer rotor and the circumferential bearing wall does not become too large. Such process steps are not only time-consuming, but above all expensive.

SUMMARY OF THE INVENTION

Therefore, an aspect of the invention aims to reduce the drive output of the rotary pump and to provide a rotary pump which can be manufactured cost-effectively.

In order to achieve this, an aspect of the invention proposes a rotary pump for delivering a fluid, said pump comprising a housing featuring a delivery space. The delivery space is surrounded and axially delineated on its end sides by the housing and comprises an inlet for the fluid on a low-pressure side of the rotary pump and an outlet for the fluid on a high-pressure side of the rotary pump. The housing can be formed in multiple pieces, in particular two pieces. The housing preferably comprises at least a housing cover and a housing cup. Preferably, the housing cup delineates the delivery space on the radially outer side and on one axial end side, while the housing cover axially delineates the delivery space on the end side of the delivery space facing away from the housing cup.

An inner rotor which can be rotated about a rotational axis is formed in the delivery space of the rotary pump, as is an outer rotor which can be rotated about a pump rotational axis and which forms delivery cells with the inner rotor. The pump rotational axis of the inner rotor is preferably formed eccentrically with respect to the pump rotational axis of the outer rotor, i.e. the pump rotational axis of the inner rotor and the pump rotational axis of the outer rotor exhibit an offset. The eccentricity between the pump rotational axis of the outer rotor and the pump rotational axis of the inner rotor can be constant or variable while the pump is in operation. If the eccentricity between the two pump rotational axes is variable, it can for example be controlled and in particular regulated in accordance with the operational state of the rotary pump.

The inner rotor of the rotary pump is preferably driven via a drive means, in particular a drive shaft, wherein the inner rotor can drive the outer rotor. In alternative embodiments, the outer rotor can also be driven by a drive means, in particular a drive shaft. The outer rotor can then drive the inner rotor. It is also possible for both the inner rotor and the outer rotor to be driven by a drive means.

The rotary pump is preferably embodied as an electrically driven rotary pump. This means that drive means, for example a drive shaft, of the inner rotor and/or outer rotor can be driven by an electric motor. In alternative embodiments, the inner rotor and/or outer rotor can be driven by the assembly to which fluid is to be supplied, in particular the engine of a motor vehicle.

The rotary pump is preferably embodied as an internal toothed wheel pump, wherein the outer rotor is formed by an internally toothed ring and the inner rotor is formed by an externally toothed wheel. The inner rotor preferably comprises at least one tooth less than the outer rotor. The outer rotor can for example comprise five teeth, and the inner rotor can for example comprise four teeth. The delivery cells can for example be formed by the teeth of the outer rotor interlocking with the teeth of the inner rotor. Due in particular to the eccentricity between the two pump rotational axes, the size of the delivery cells changes in the circumferential direction of the outer rotor, in particular in the rotary direction of the outer rotor. Internal toothed wheel pumps are sufficiently well known to the person skilled in the art, hence their structure will not be discussed in further detail at this juncture. In alternative embodiments, the rotary pump can for example also be formed by a pendulum-slider pump.

A circumferential bearing wall which is formed by the housing or arranged in the housing surrounds the outer rotor and rotatably mounts it in a sliding contact. The outer rotor can be mounted by the circumferential bearing wall in a radial sliding contact, in particular a circumferential sliding contact. The circumferential bearing wall can be formed by the housing, in particular the housing cup, or by a separate component which is arranged in the housing and is in particular a housing ring. The circumferential bearing wall is preferably part of the housing, in particular the housing cup, and surrounds the outer rotor on the radially outer side. The circumferential bearing wall can be joined to or original-molded, for example cast or sintered, with an end wall of the housing and together with the end wall can form the housing cup.

The circumferential bearing wall comprises an inner circumferential surface which is preferably formed cylindrically, in particular circular-cylindrically. The outer rotor comprises an outer circumferential surface which is preferably formed cylindrically, in particular circular-cylindrically. The circumferential bearing wall, in particular the inner circumferential surface of the circumferential bearing wall, and the outer rotor, in particular the outer circumferential surface of the outer rotor, are preferably formed concentrically with respect to each other.

The circumferential bearing wall preferably surrounds the outer rotor with a clearance such that the inner diameter of the circumferential bearing wall is larger than the outer diameter of the outer rotor. The inner diameter of the circumferential bearing wall can be at least 60 μm, in particular at least 70 μm, larger than the outer diameter of the outer rotor. The inner diameter of the circumferential bearing wall is preferably at most 110 μm, preferably at most 95 μm, larger than the outer diameter of the outer rotor. The clearance between the outer rotor and the circumferential bearing wall should not be too large, in order to prevent a fluid flow through the gap between the outer rotor and the circumferential bearing wall.

The circumferential bearing wall and/or the outer rotor preferably comprise multiple blind pockets which are radially open towards the outer rotor and/or circumferential bearing wall. The circumferential bearing wall preferably comprises multiple blind pockets which are radially open towards the outer rotor. In alternative embodiments, the outer rotor can comprise multiple blind pockets which are radially open towards the circumferential bearing wall. The blind pockets interrupt the cylindrical, in particular circular-cylindrical, inner circumferential surface of the circumferential bearing wall and/or the cylindrical, in particular circular-cylindrical, outer circumferential surface of the outer rotor.

In this way, the outer rotor and the inner circumferential surface are not in contact with each other in the region of the blind pockets. This can reduce the effort and/or expense of machining the inner circumferential surface of the circumferential bearing wall and/or the effort and/or expense of machining the outer circumferential surface of the outer rotor and save on cost. Fluid which is situated in the gap between the outer rotor and the circumferential bearing wall due to unavoidable leakage and which is slaved by the rotation of the outer rotor can also flow off into the blind pockets. This can significantly reduce the viscous friction.

The blind pockets are preferably arranged in an asymmetrical distribution over the circumference of the outer rotor in relation to the circumferential direction. In particular, at least two adjacent blind pockets are at a distance from each other, over the circumference of the outer rotor in relation to the circumferential direction, which is different to the other distances between the blind pockets. In particular, each two adjacent blind pockets delineate an arc length of the outer circumference of the outer rotor in the circumferential direction, wherein the individual arc lengths delineated by the blind pockets can be different or identical in size. Preferably, at least two adjacent blind pockets delineate an arc length of the outer circumference of the outer rotor in the circumferential direction which is different from the other arc lengths delineated by the blind pockets.

At least one blind pocket, preferably each of the blind pockets, preferably overlaps by more than 80% or in particular more than 90% of its circumferential extent with either the inlet only or the outlet only. At least one of the blind pockets, in particular each of the blind pockets, preferably overlaps across its entire circumferential extent with either the inlet only or the outlet only.

In preferred embodiments, the rotary pump comprises at least three or four blind pockets and/or at most five or six blind pockets. The rotary pump preferably comprises an even number of blind pockets, in particular four blind pockets. In preferred embodiments, the rotary pump comprises an even number of blind pockets, in particular four blind pockets, wherein a first half of the blind pockets in each case, in particular two of the blind pockets, overlap by more than 80% or more than 90% of their circumferential extent with the inlet only, and a second half of the blind pockets, in particular the other two blind pockets, overlap by more than 80% or more than 90% of their circumferential extent with the outlet only.

In preferred embodiments, the rotary pump comprises an even number of blind pockets, in particular four blind pockets, which are arranged mirror-symmetrically in relation to the inner diameter of the circumferential bearing wall and/or the outer diameter of the outer rotor. The rotary pump preferably comprises four blind pockets, wherein two of the blind pockets form a pair of pockets and the two pairs of pockets are formed mirror-symmetrically with respect to each other in relation to the inner diameter of the circumferential bearing wall and/or the outer diameter of the outer rotor.

In particular, the rotary pump comprises an even number of blind pockets which can be grouped into a first and a second half, wherein the blind pockets of the first half overlap by more than 80% or more than 90% of their circumferential extent with the inlet only, and the blind pockets of the second half overlap by more than 80% or more than 90% of their circumferential extent with the outlet only. The two halves can be formed mirror-symmetrically with respect to each other in relation to the inner diameter of the circumferential bearing wall and/or the outer diameter of the outer rotor.

In particular, the rotary pump comprises four blind pockets which can be grouped into two pairs of pockets, wherein the blind pockets of the first pair of pockets overlap by more than 80% or more than 90% of their circumferential extent with the inlet only, and the blind pockets of the second pair of pockets overlap by more than 80% or more than 90% of their circumferential extent with the outlet only. The two pairs of pockets can be formed mirror-symmetrically with respect to each other in relation to the inner diameter of the circumferential bearing wall and/or the outer diameter of the outer rotor.

One of the blind pockets, in particular each of the blind pockets, preferably extends at least twice as far and preferably at least three times as far in the circumferential direction of the outer rotor as in the radial direction of the outer rotor. The axial extent of one of the blind pockets, in particular each blind pocket, from a first end of the pocket up to a second end of the pocket can correspond to at least 70%, preferably at least 80%, of the axial extent of the outer rotor from a first end side of the outer rotor up to a second end side of the outer rotor.

One of the blind pockets, in particular each of the blind pockets, can be formed as a recess, in particular a cavity, in the circumferential bearing wall and/or in the outer rotor, which extends in the axial direction from the second end side of the outer rotor towards the first end side of the outer rotor. The base of the pocket, preferably the base of each blind pocket, can exhibit a radius. The radius of the base of the individual pocket and in particular of each blind pocket is preferably smaller than the radius of the outer circumference of the outer rotor and/or the radius of the inner circumference of the circumferential bearing wall.

In relation to the circumference of the outer rotor, the blind pockets together exhibit an extent in the circumferential direction of the outer rotor which corresponds to at least 20%, in particular at least 25%, of the circumference of the outer rotor, i.e. the blind pockets preferably overlap at least 20% of the outer circumference of the outer rotor, in particular at least 25% of the outer circumference of the outer rotor. In relation to the circumference of the outer rotor, the blind pockets together exhibit an extent in the circumferential direction of the outer rotor which corresponds to at most 50%, in particular at most 60%, of the circumference of the outer rotor, i.e. the blind pockets preferably overlap at most 50% of the outer circumference of the outer rotor, in particular at most 60% of the outer circumference of the outer rotor.

In particular, all of the blind pockets together preferably extend in the circumferential direction of the outer rotor over a total of more than 120°, in particular more than 150°, of the outer circumference of the outer rotor, and/or all of the blind pockets together preferably extend in the circumferential direction of the outer rotor over a total of at most 210°, in particular at most 180°, of the outer circumference of the outer rotor. One of the blind pockets, in particular each of the blind pockets, preferably extends in the circumferential direction over an arc angle which is at least as large as the arc angle of a tooth gap of the outer rotor on the pitch circle of the outer rotor.

In relation to the diameter of the outer rotor, the blind pockets exhibit a radial extent which preferably corresponds to at most 10% of the outer diameter of the outer rotor, in particular at most 8% of the outer diameter of the outer rotor.

Preferably, the blind pockets are fluidically separated from each other in the region of the sliding contact between the outer rotor and the circumferential bearing wall. Preferably, the blind pockets are fluidically separated from each other in the region of the sliding contact between the outer rotor and the circumferential bearing wall in every rotational position of the outer rotor. To this extent, the sliding contact can also be regarded as a sealing contact. Where, in the course of the application, the blind pockets are said to be fluidically separated from each other, this means in particular that no fluid flow occurs between one blind pocket and one of the other blind pockets. This does not include natural, in particular unavoidable, leaks due to the rotation of the outer rotor. Thus, in particular, no fluid is deliberately fed, for example through a supply line, into the sliding contact between the circumferential bearing wall and the outer rotor.

In preferred embodiments, the outer rotor extends axially beyond at least one of the blind pockets, preferably each of the blind pockets, towards the first end side of the outer rotor in its sliding contact with the circumferential bearing wall. This means that the extent of the outer rotor in the axial direction can be greater than the axial extent of one blind pocket and in particular greater than the axial extent of each pocket. Alternatively, or additionally, the circumferential bearing wall can extend axially beyond at least one of the blind pockets, preferably each of the blind pockets, towards the first end side of the outer rotor in its sliding contact with the outer rotor. This means that the extent of the circumferential bearing wall in the axial direction can be greater than the axial extent of one blind pocket and in particular greater than the axial extent of each pocket.

If the outer rotor and/or circumferential bearing wall extend(s) axially beyond at least one of the blind pockets, preferably each of the blind pockets, towards the first end side of the outer rotor in its/their sliding contact, then the blind pocket, in particular each blind pocket, terminates in a dead end in the region of the outer circumferential surface of the outer rotor which is in sliding contact and/or in the region of the inner circumferential surface of the circumferential bearing wall which is in sliding contact. One blind pocket, in particular each of the blind pockets, can thus be fluidically separated from the one or more other blind pockets, in particular in the region of the first end side of the outer rotor.

The circumferential bearing wall preferably surrounds the outer rotor in a sliding contact in the region of the first end side of the outer rotor. In particular, the outer circumferential surface of the outer rotor is in sliding contact with the inner circumferential surface of the circumferential bearing wall over the entire outer circumference of the outer rotor and/or the entire inner circumference of the circumferential bearing wall in the region of the first end side of the outer rotor.

The sliding contact between the outer circumferential surface of the outer rotor and the inner circumferential surface of the circumferential bearing wall preferably extends over 360° in the region of the first end side of the outer rotor, such that a radial sealing gap is formed between the outer circumferential surface of the outer rotor and the inner circumferential surface of the circumferential bearing wall in the region of the first end side of the outer rotor. The radial sealing gap preferably extends in the axial direction of the outer rotor over at least 10%, in particular at least 15%, of the axial extent of the outer rotor from its first end side up to its second end side.

The radial sealing gap between the circumferential bearing wall and the outer rotor is preferably interrupted by at most one of the blind pockets and in particular by none of the blind pockets in the region of the first end side of the outer rotor. The radial sealing gap preferably serves to prevent a fluid connection between the blind pockets in the region of the first end side of the outer rotor.

One blind pocket, preferably each of the blind pockets, preferably terminates axially in an opening on the circumferential bearing wall and/or outer rotor on the second end side of the outer rotor, i.e. one of the blind pockets, preferably each of the blind pockets, comprises a second end of the pocket, which is preferably formed with an opening, in the region of the second end side of the outer rotor. The outer rotor and/or circumferential bearing wall preferably does/do not extend axially beyond at least one of the blind pockets, preferably each of the blind pockets, towards the second end side of the outer rotor in its sliding contact.

The circumferential bearing wall and the outer rotor can fluidically separate the respective blind pocket, preferably each of the blind pockets, from the other blind pockets at their end which terminates in an opening, in their sliding contact, in particular radial sliding contact. The outer circumferential surface of the outer rotor is preferably not in contact with the inner circumferential surface of the circumferential bearing wall in the region of the blind pockets, while the outer circumferential surface of the outer rotor and the inner circumferential surface of the circumferential bearing wall are in sliding contact, preferably sealing contact, in the region between the blind pockets.

The housing preferably comprises a housing cover which axially delineates the delivery chamber on the second end side of the outer rotor and rests against the circumferential bearing wall in an axial sealing contact. The housing cover can in particular form an axial sealing gap with the circumferential bearing wall. The axial sealing contact between the housing cover and the circumferential bearing wall is preferably formed over the entire circumference of the circumferential bearing wall in the circumferential direction of the circumferential bearing wall. The axial sealing contact between the circumferential bearing wall and the housing cover, in particular between the end surface of the circumferential bearing wall formed in the region of the second end side of the outer rotor and the end side of the housing cover facing the circumferential bearing wall, preferably extends over 360° of the outer circumference of the circumferential bearing wall in the region of the second end side of the outer rotor. In this way, the blind pockets can be fluidically separated from each other in the region of the second end side of the outer rotor. Preferably, if the blind pockets comprise an end which terminates in an opening in the region of the second end side of the outer rotor, the blind pockets are fluidically separated from each other in the region of the second end of the pocket by the axial sealing contact, in particular the axial sealing gap.

The housing cover can rest against the outer rotor in an axially sealing sliding contact. Particularly preferably, the second end side of the outer rotor and the housing cover, in particular an end surface of the housing cover facing the outer rotor, exhibit an axial sealing gap. The housing cover preferably rests against the outer rotor in an axial sliding contact, in particular an axial sealing contact. The axial sealing gap between the housing cover and the circumferential bearing wall can be smaller than the axial sealing gap between the housing cover and the outer rotor.

The axial sealing gap between the housing cover and the outer rotor is preferably formed over the entire circumference of the outer rotor in the circumferential direction of the outer rotor. The axial sealing gap between the second end side of the outer rotor and the housing cover, in particular between the second end side of the outer rotor and the end side of the housing cover facing the outer rotor, preferably extends over 360° of the outer circumference of the outer rotor in the region of the second end side of the outer rotor. In this way, the blind pockets can be fluidically separated from each other in the region of the second end side of the outer rotor. Preferably, if the blind pockets comprise an end which terminates in an opening in the region of the second end side of the outer rotor, the blind pockets are fluidically separated from each other in the region of the second end of the pocket by the axial sealing gap.

The first end side of the outer rotor can comprise a chamfer along its circumferential outer periphery. A chamfer is preferably an ablation of edge material, i.e. the circumferential outer periphery of the outer rotor is preferably not formed with a sharp edge on its first end side. The chamfer can be rounded, i.e. can exhibit a radius. The chamfer is preferably formed over the entire length of the circumferential outer periphery. The chamfer preferably measures at least 200 μm or at least 300 μm and/or at most 400 μm or at most 500 μm in the radial direction. The chamfer preferably measures at least 200 μm or at least 300 μm and/or at most 400 μm or at most 500 μm in the axial direction.

The chamfer, in particular the rotor bevel, can be produced when manufacturing the outer rotor, in particular when original-moulding the outer rotor. The outer rotor is preferably manufactured in an original-moulding method, for example by sintering or casting. In alternative embodiments, the chamfer—in particular, the rotor bevel—can be latterly formed by deburring the circumferential outer edge, for example by brushing, grinding or filing.

The first end side of the outer rotor particularly preferably comprises a rotor bevel along its circumferential outer periphery. Within the meaning of the application, a bevel is preferably understood to mean a chamfer in the form of a sloped, in particular planar surface which is dimensionally defined in terms of its width and angle, wherein the sloped surface is preferably curved exclusively in the circumferential direction of the outer rotor.

The sloped surface, in particular the rotor bevel, can preferably be formed at an angle of 45° to the axial direction of the outer rotor. In alternative embodiments, the sloped surface—in particular, the rotor bevel—can also be formed at an angle of 60° to the axial direction of the outer rotor. The rotor bevel can be formed at any other angle greater than 0° and less than 90° to the axial direction of the outer rotor. The rotor bevel preferably measures at least 200 μm or at least 300 μm and/or at most 400 μm or at most 500 μm in the radial direction. The rotor bevel preferably measures at least 200 μm or at least 300 μm and/or at most 400 μm or at most 500 μm in the axial direction. In particular, the rotor bevel measures at least 300 μm in the radial and axial directions at an angle of 45° to the axial direction of the outer rotor.

The circumferential bearing wall can comprise an inner edge transition along its circumferential inner periphery on the first end side of the outer rotor, i.e. on the axial side of the first end side of the outer rotor. An inner edge transition is preferably an overhang of material, i.e. the circumferential inner periphery of the circumferential bearing wall is preferably not formed with a sharp edge on the first end side of the outer rotor. The inner edge transition can be rounded, i.e. can exhibit a radius. The inner edge transition is preferably formed over the entire length of the circumferential inner periphery. In particular, if the circumferential bearing wall is formed in one piece with an end wall of the housing, the inner edge transition is formed along the inner edge between the end wall and the circumferential bearing wall.

Particularly preferably, the circumferential bearing wall comprises an inner edge burr along its circumferential inner periphery on the first end side of the outer rotor. Within the meaning of the application, an inner edge burr is preferably understood to mean an inner edge transition in the form of a sloped, in particular planar surface which is dimensionally defined in terms of its width and angle, wherein the sloped surface is preferably curved exclusively in the circumferential direction of the circumferential bearing wall.

The inner edge transition, in particular the inner edge burr, can be produced when manufacturing the circumferential bearing wall, in particular when original-moulding the circumferential bearing wall. The circumferential bearing wall is preferably manufactured as part of the housing cup in an original-moulding method, for example by sintering or casting. The inner edge transition, in particular the inner edge burr, is preferably formed in a subsequent production step when machine-finishing the inner circumferential surface of the circumferential bearing wall, for example by milling, grinding or honing.

The sloped surface, in particular the inner edge burr, can preferably be formed at an angle of 45° to the axial direction of the outer rotor and/or circumferential bearing wall. In alternative embodiments, the sloped surface—in particular, the inner edge burr—can also be formed at an angle of 60° to the axial direction of the outer rotor and/or circumferential bearing wall. The inner edge burr can be formed at any other angle greater than 0° and less than 90° to the axial direction of the outer rotor and/or circumferential bearing wall. The inner edge burr preferably measures at least 200 μm or at least 300 μm and/or at most 400 μm or 500 μm in the radial direction. The inner edge burr preferably measures at least 200 μm or at least 300 μm and/or at most 400 μm or at most 500 μm in the axial direction. In particular, the inner edge burr measures at least 300 μm in the radial and axial directions at an angle of 45° to the axial direction of the outer rotor.

In particularly preferred embodiments, the outer rotor comprises a chamfer, the circumferential bearing wall comprises an inner edge transition, and the chamfer of the outer rotor overlaps with the inner edge transition of the circumferential bearing wall, i.e. the inner edge transition is particularly preferably formed in accordance with the chamfer. The inner edge transition forms an imprint or negative of the chamfer, so to speak. The inner edge transition preferably exhibits the same radius or angle as the chamfer. If the inner edge transition is an inner edge burr, the chamfer is preferably formed as a rotor bevel, wherein the angle with respect to the axial direction of the outer rotor and the extent in the axial direction of the inner edge burr are equal to the angle with respect to the axial direction of the outer rotor and the extent in the axial direction of the rotor bevel.

The chamfer is particularly preferably a rotor bevel which measures at least 300 μm in the radial direction and at least 300 μm in the axial direction at an angle of 45° to the axial direction of the outer rotor, and the inner edge transition is particularly preferably an inner edge burr which measures at least 300 μm in the radial direction and at least 300 μm in the axial direction at an angle of 45° to the axial direction of the outer rotor.

In preferred embodiments, the circumferential bearing wall does not comprise a chamfer or only comprises a small second chamfer along its circumferential inner periphery on the second end side of the outer rotor and/or the second end side of the outer rotor does not comprise a chamfer or only comprises a small second chamfer along its circumferential outer periphery. If the circumferential bearing wall does not comprise a chamfer along its circumferential inner periphery on the second end side of the outer rotor and/or the second end side of the outer rotor does not comprise a chamfer along its circumferential outer periphery, the edge along the circumferential inner periphery of the circumferential bearing wall and/or along the circumferential outer periphery of the outer rotor is formed as a sharp edge.

If the circumferential bearing wall does not comprise a chamfer or only comprises a small second chamfer along its circumferential inner periphery on the second end side of the outer rotor and/or the second end side of the outer rotor does not comprise a chamfer or only comprises a small second chamfer along its circumferential outer periphery, at least one of the blind pockets and preferably each of the blind pockets can terminate axially in an opening on the second end side of the outer rotor on the circumferential bearing wall and/or on the outer rotor. The missing chamfer or the small second chamfer along the circumferential inner periphery of the circumferential bearing wall and/or along the circumferential outer periphery of the outer rotor then ensures that the blind pockets do not exhibit a fluidic connection, in particular in the form of a fluid flow, along the circumferential inner periphery of the circumferential bearing wall and/or along the circumferential outer periphery of the outer rotor in the region of the second end side of the outer rotor. The small second chamfer, if provided, along the circumferential inner periphery of the circumferential bearing wall and/or along the circumferential outer periphery of the outer rotor is preferably small enough that no fluid flow can be formed between the individual blind pockets.

A very small second chamfer is in particular understood to mean deburring along the circumferential inner periphery of the circumferential bearing wall and/or along the circumferential outer periphery of the outer rotor, in particular deburring by brushing, filing or grinding. This means that when a small second chamfer is mentioned, it is the result of a deburring measure and not a slope which is dimensionally defined in terms of its width and angle. This means the small second chamfer, if provided, is not a bevel having a slope which is dimensionally defined in terms of its width and angle. The small second chamfer preferably exhibits a maximum extent of 100 μm in the axial direction. In particular, the small second chamfer exhibits a maximum extent of 100 μm in the radial direction.

The first end side of the outer rotor can comprise a chamfer, in particular a rotor bevel, along its circumferential outer periphery, and the second end side of the outer rotor can comprise a small second chamfer along its circumferential outer periphery, wherein the chamfer—in particular, the rotor bevel—is at least three times and in particular four times as large in the axial direction as the second chamfer.

The circumferential bearing wall can comprise an inner edge transition, in particular an inner edge burr, along its circumferential inner periphery on the first end side of the outer rotor and can comprise a small chamfer along its circumferential inner periphery on the second end side of the outer rotor, wherein the inner edge transition—in particular, the inner edge burr—is at least three times and in particular four times as large in the radial direction as the chamfer of the outer circumferential edge on the first end side of the outer rotor.

BRIEF DESCRIPTION OF THE DRAWINGS

The invention shall be explained below on the basis of an example embodiment. Features disclosed by the example embodiment advantageously develop the subject-matter of the claims and the embodiments explained above, but do not restrict the invention. There is shown:

and

Figure 7:
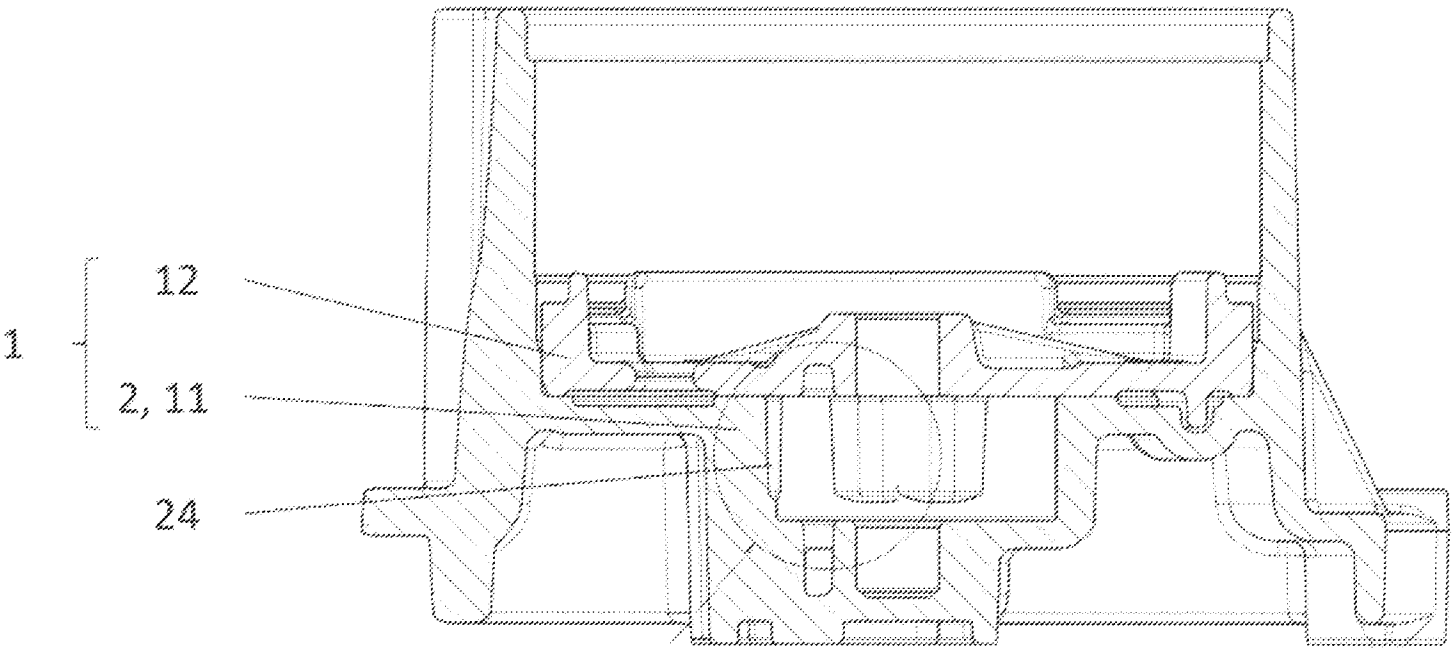
FIG. 7 an axial section through the rotary pump with no delivery member.
Figure 8:
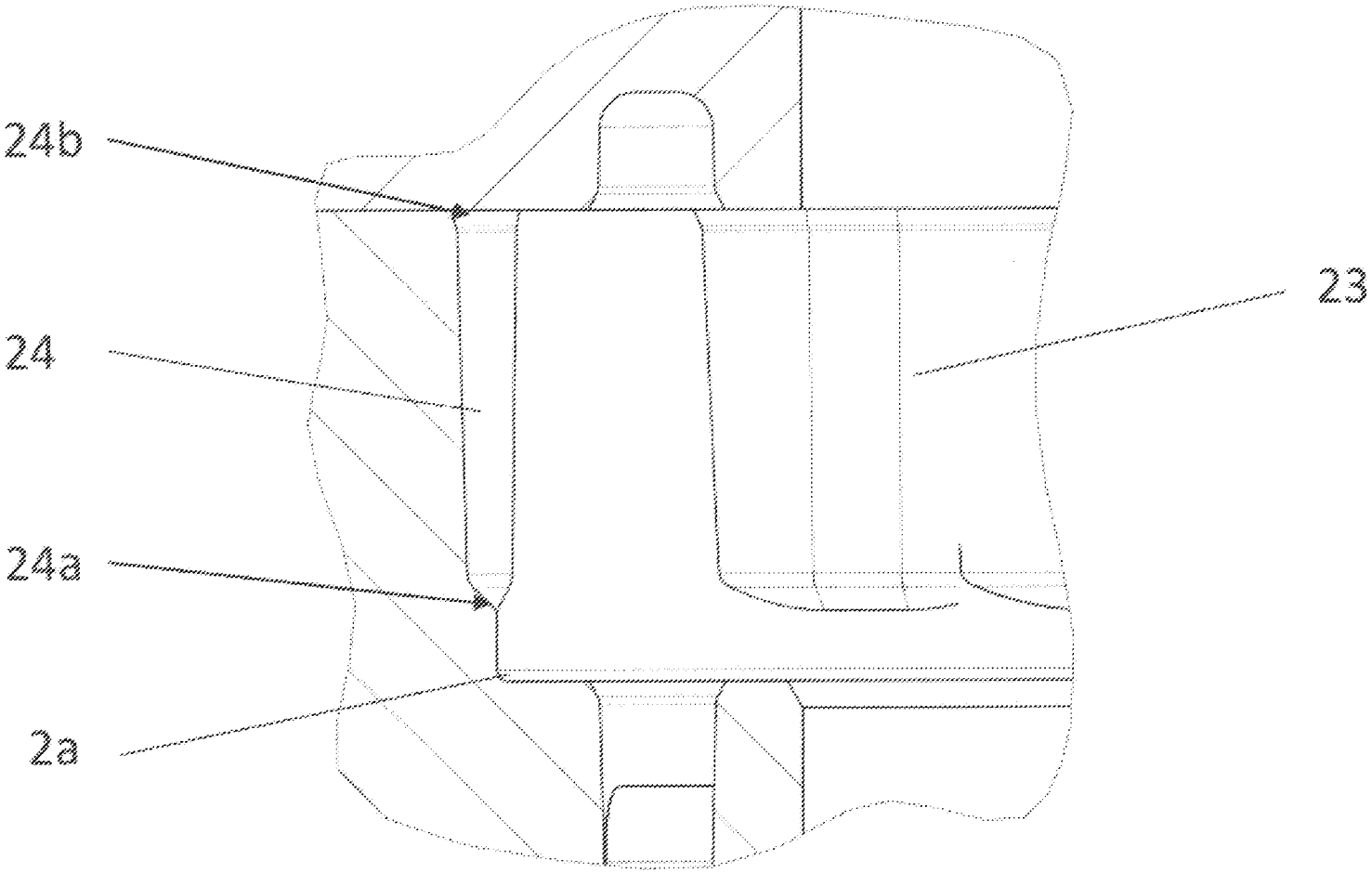

FIG. 8 a detailed view of the axial section from FIG. 7.

DETAILED DESCRIPTION OF THE INVENTION

All the figures show a rotary pump and its components in an example embodiment. An aspect of the invention is not restricted to the example embodiment and can be embodied in accordance with the preceding embodiments.

Figure 1:
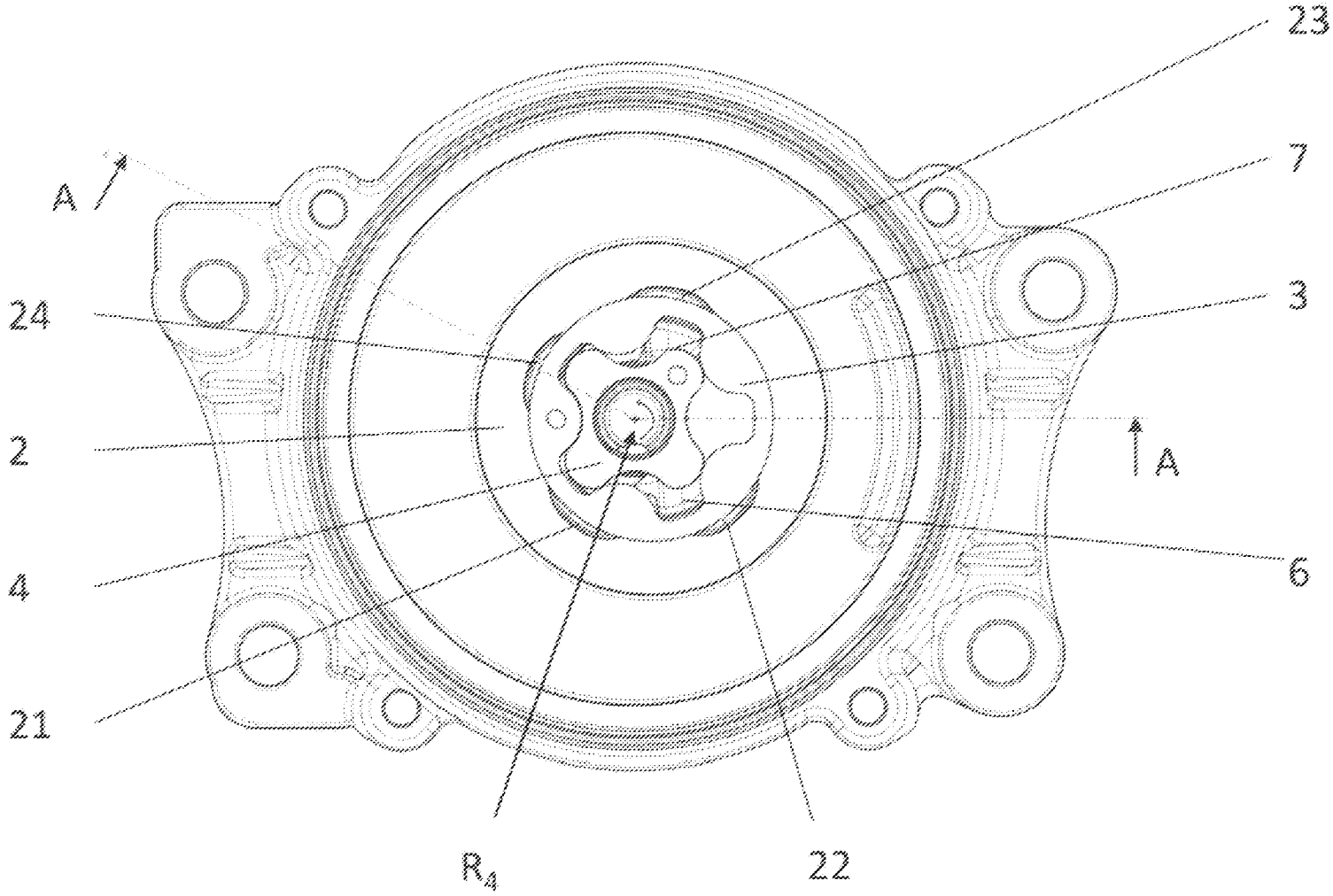
FIG. 1 a plan view onto the delivery space of the rotary pump.
Figure 2:
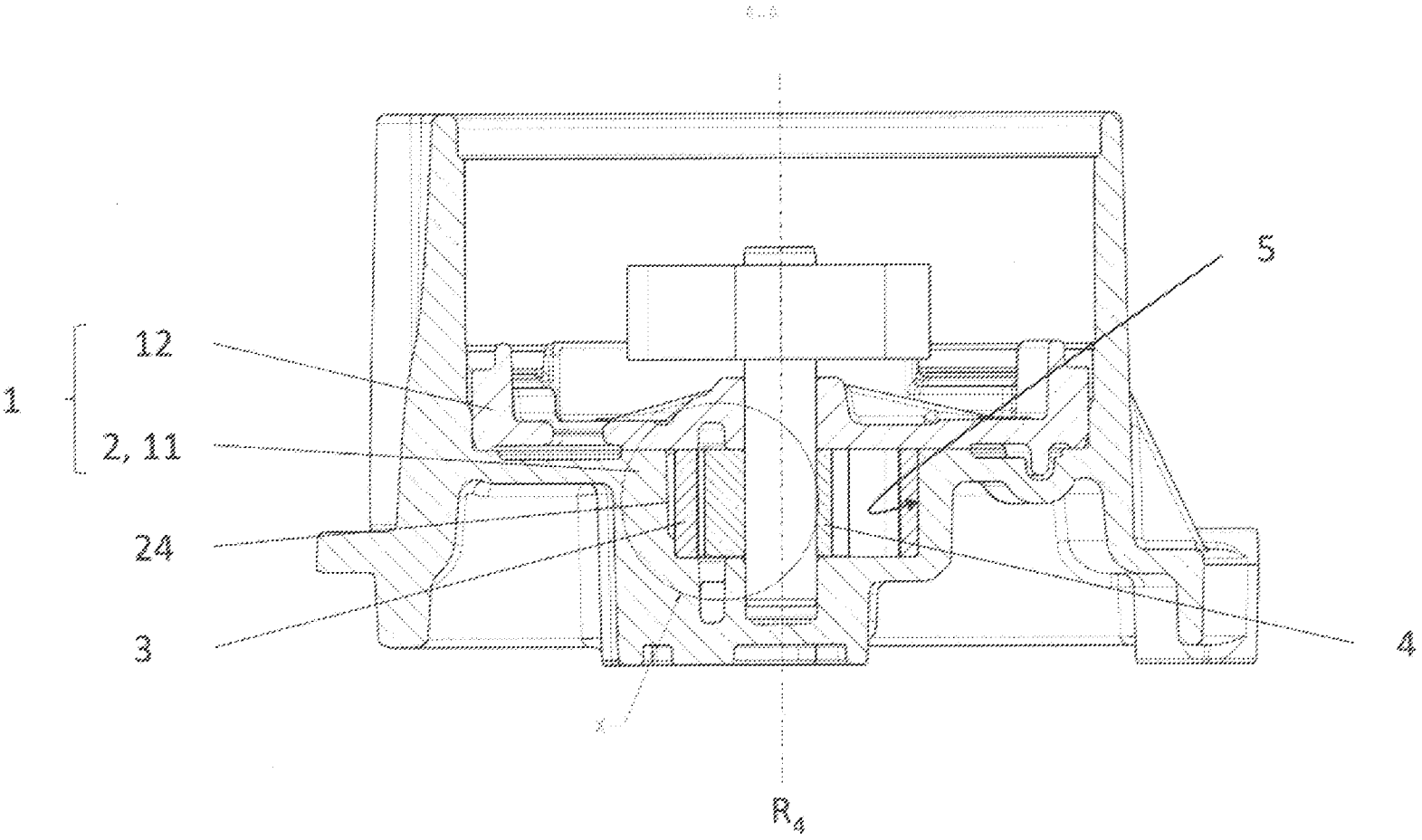
FIG. 2 a section in the axial direction of the rotary pump with a delivery member.
Figure 3:
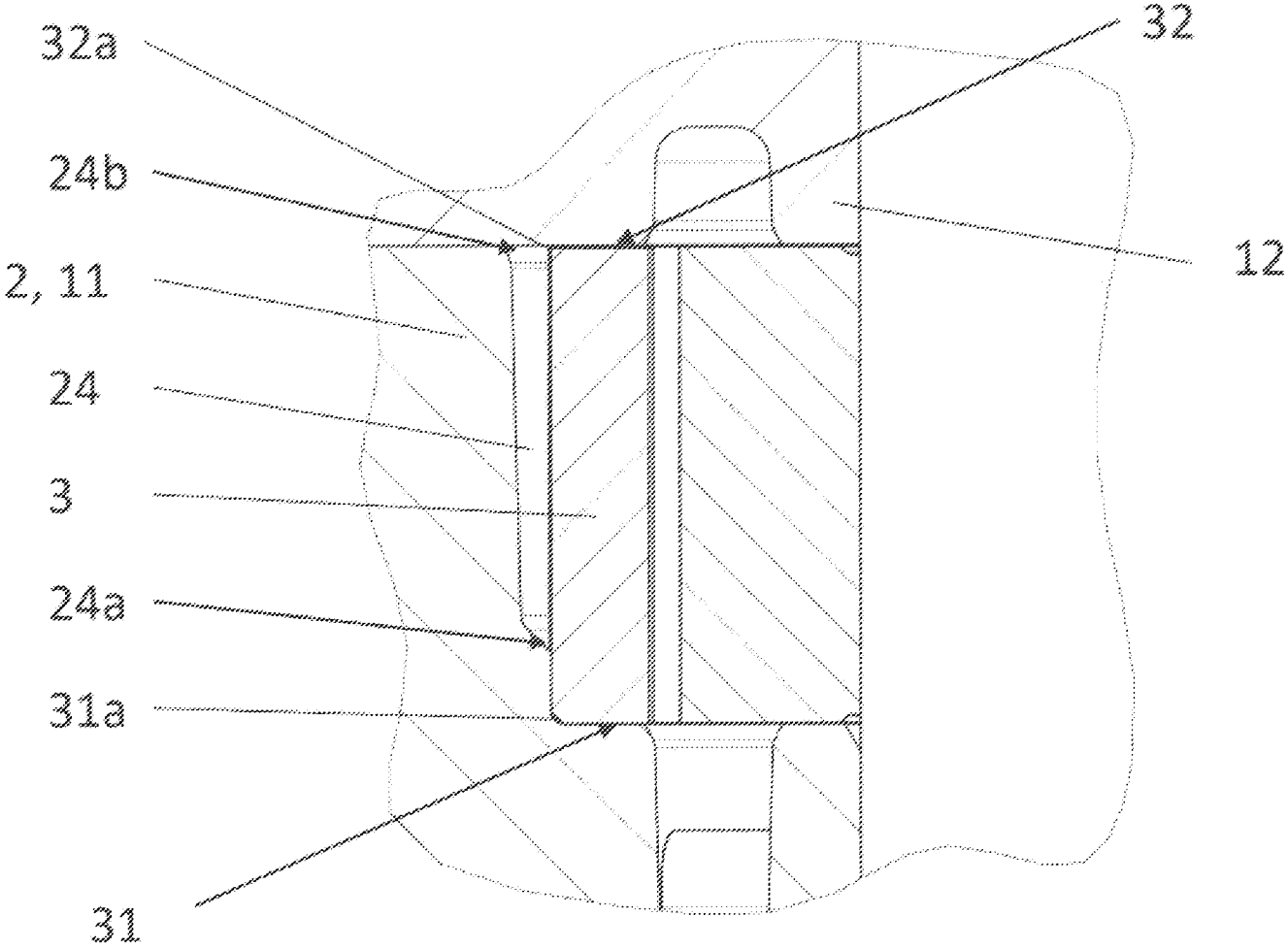
FIG. 3 a detailed view of the section from FIG. 2.
Figure 6:
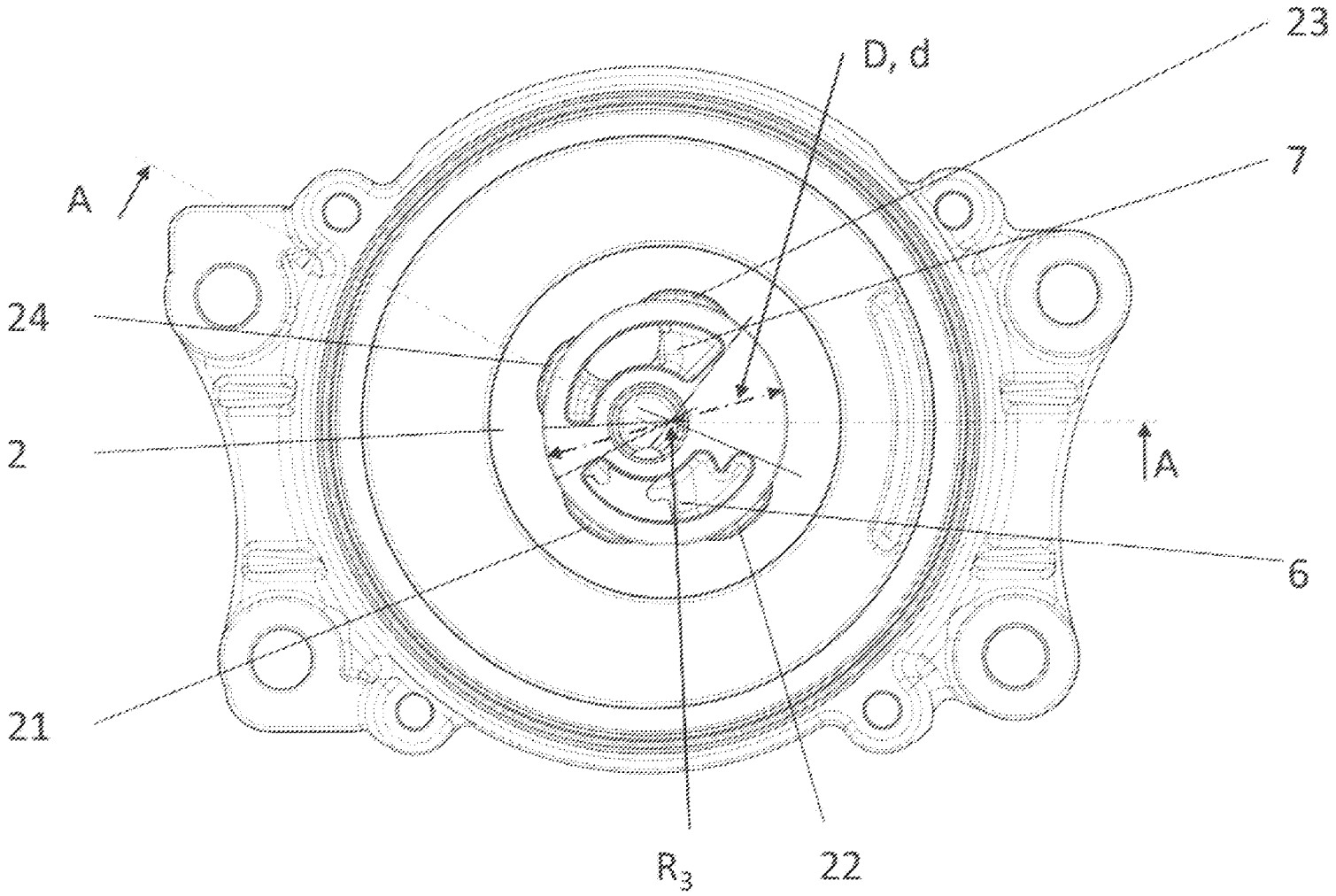
FIG. 6 a plan view onto the delivery space of the rotary pump with no delivery member.

FIG. 1 shows a plan view onto the delivery space of the rotary pump, while FIG. 2 shows a section through the rotary pump according to FIG. 1 in the axial direction of the rotary pump. FIG. 3 shows a detailed view of FIG. 2. FIGS. 6 to 8 show the rotary pump of FIG. 1, but without the delivery member 3, 4.

The rotary pump comprises a housing 1 featuring a delivery space 5 which the housing 1 surrounds and axially delineates on the end sides. As can be seen in particular in FIGS. 2 and 7, the housing 1 comprises a housing cup 11 and a housing cover 12. The housing cover 12 delineates the delivery space in the axial direction, while the housing cup 11 surrounds the delivery space in the radial direction and axially delineates it on the side facing away from the housing cover 12. The delivery space 5 comprises an inlet 6 for a fluid on a low-pressure side of the rotary pump and an outlet 7 for the fluid on the high-pressure side of the pump.

A delivery member which is formed in the delivery space 5 delivers the fluid from the low-pressure side of the rotary pump, in particular the inlet 6, to the high-pressure side of the rotary pump, in particular the outlet 7. The rotary pump is embodied as an internal toothed wheel pump or gerotor pump. The delivery member comprises an outer rotor 3 and an inner rotor 4, wherein the outer rotor 3 is formed by an internally toothed ring, the inner rotor 4 is formed by an externally toothed wheel, and the teeth of the inner rotor 4 can be moved into engagement with the teeth of the outer rotor 3 by rotating the two rotors. The inner rotor 4 preferably comprises one tooth less than the outer rotor 3. In the example embodiment, the outer rotor 3 comprises five teeth and the inner rotor 4 comprises four teeth, wherein the number of individual teeth is only an example and can vary.

Due to the engagement between the inner rotor 4 and the outer rotor 3, the two rotors form delivery cells which can change their volume in the circumferential direction of the outer rotor 3 as the two rotors rotate. In the present example embodiment, the inner rotor 4 is driven by a drive means, in particular a drive shaft, as disclosed in FIG. 2. The inner rotor 4 is mounted such that it can rotate about the pump rotational axis R4 and drives the outer rotor 3, in particular by the individual teeth engaging with each other. The inner rotor 4 is preferably driven by means of an electric motor. In alternative embodiments, the inner rotor 4 can also for example be driven by the assembly to be supplied. Also, in alternative embodiments, the outer rotor 3 can also be driven by means of a drive means, wherein the inner rotor 4 is driven via the outer rotor 3.

The pump rotational axis R4 of the inner rotor 4 is formed eccentrically with respect to the pump rotational axis R3 of the outer rotor 3, i.e. the pump rotational axis R4 of the inner rotor 4 and the pump rotational axis R3 of the outer rotor 3 exhibit an offset. The eccentricity between the pump rotational axis R3 of the outer rotor 3 and the pump rotational axis R4 of the inner rotor 4 is constant in the present example embodiment, but can also be variable in alternative embodiments. If the eccentricity between the two pump rotational axes is variable, it can be changed, in particular controlled, for example in accordance with the operational state of the rotary pump.

The housing cup 11 forms a circumferential bearing wall 2 which surrounds the outer rotor 3 and mounts it, such that it can rotate about the pump rotational axis R3, in a sliding contact. In alternative embodiments, the circumferential bearing wall 2 can also for example be formed by a separate ring which is inserted into the delivery space 5. As shown for example in FIG. 2, the circumferential bearing wall 2 is formed in one piece with the housing cup 11, in particular an end wall of the housing cup 11, in particular in an original-moulding method.

As can be seen in FIG. 1, the circumferential bearing wall 2 comprises multiple blind pockets 21, 22, 23, 24 which are radially open towards the outer rotor 3 and fluidically separated from each other in the region of the sliding contact between the outer rotor 3 and the circumferential bearing wall 2. In accordance with the example embodiment, the rotary pump comprises four blind pockets 21, 22, 23, 24 which are formed in the circumferential bearing wall 2. In alternative embodiments, the number of blind pockets can vary and is not intended to be restricted to four. The blind pockets are fluidically separated from each other in every rotational position of the outer rotor 3, i.e. irrespective of the rotational angular position of the outer rotor 3, the blind pockets 21, 22, 23, 24 are fluidically separated from each other in the region of the radial sliding contact between the outer rotor 3 and the circumferential bearing wall 2.

In alternative embodiments, the blind pockets 21, 22, 23, 24 are formed in the outer rotor 3 and are radially open towards the circumferential bearing wall 2. Even if the blind pockets 21, 22, 23, 24 are formed in the outer rotor 3, they are fluidically separated from each other in the region of the radial sliding contact between the outer rotor 3 and the circumferential bearing wall 2, irrespective of the rotational angular position of the outer rotor 3.

The circumferential bearing wall 2 surrounds the outer rotor 3 in a radial sliding contact in the region of a first end side 31 of the outer rotor 3. In particular, the outer circumferential surface of the outer rotor 3 is in sliding contact with the inner circumferential surface of the circumferential bearing wall 2 over the entire outer circumference of the outer rotor 3 and/or the entire inner circumference of the circumferential bearing wall 2 in the region of the first end side 31 of the outer rotor 3, in order to form a radial sealing gap. The radial sealing gap extends in the axial direction of the outer rotor 3 over at least 10%, in particular at least 15%, of the axial extent of the outer rotor 3 from its first end side 31 up to its second end side 32.

As can be seen in FIG. 1 and FIG. 6, the blind pockets 21, 22, 23, 24 are arranged in an asymmetrical distribution over the circumference of the outer rotor 3 in relation to the circumferential direction. In particular, the blind pockets 22 and 23 are at a distance from each other, over the circumference of the outer rotor 3 in relation to the circumferential direction, which is greater than the other distances between the individual blind pockets. The distance between the blind pocket 23 and the blind pocket 24 is then for example smaller than the distance between the blind pockets 22 and 23.

As can be seen in particular from FIG. 6, the blind pockets 23 and 24 can overlap with the outlet 7 only, in the circumferential direction of the outer rotor 3 and/or in the circumferential direction of the circumferential bearing wall 2, by more than 90% of their circumferential extent. In particular, the blind pockets 23 and 24 completely overlap with the outlet 7 in the circumferential direction of the circumferential bearing wall 2. The blind pockets 21 and 22 can also overlap with the inlet 6 only, in the circumferential direction of the outer rotor 3 and/or in the circumferential direction of the circumferential bearing wall 2, by more than 90% of their circumferential extent. In particular, the blind pockets 21 and 22 completely overlap with the inlet 6 in the circumferential direction of the circumferential bearing wall 2.

As disclosed in FIGS. 2 and 6, the rotary pump comprises four blind pockets 21, 22, 23, 24, which are arranged mirror-symmetrically in relation to the inner diameter d of the circumferential bearing wall 2 and/or the outer diameter D of the outer rotor 3, wherein the blind pockets 21 and 22 form a first pair of pockets and the blind pockets 23 and 24 form a second pair of pockets, respectively, wherein the two pairs of pockets are formed mirror-symmetrically with respect to each other in relation to the inner diameter d of the circumferential bearing wall 2 and/or the outer diameter D of the outer rotor 3. The axis of symmetry and/or inner diameter d of the circumferential bearing wall 2 and/or the outer diameter D of the outer rotor 3 are indicated in FIG. 6 as a dashed double arrow, wherein the blind pockets 21, 22 of the first pair of pockets overlap with the inlet 6 only by more than 80% or more than 90% of their circumferential extent, and the blind pockets 23, 24 of the second pair of pockets overlap with the outlet 7 only by more than 80% or more than 90% of their circumferential extent.

The blind pockets 21, 22, 23, 24 preferably extend at least twice as far and preferably at least three times as far in the circumferential direction of the outer rotor 3 as in the radial direction of the outer rotor 3. As can be seen in particular from the example of the blind pocket 24 in FIGS. 3 and 8, the axial extent of the blind pockets 21, 22, 23, 24 from a first end 24*a* of the pocket up to a second end 24*b* of the pocket can correspond to at least 70%, preferably at least 80%, of the axial extent of the outer rotor 3 from a first end side 31 up to a second end side 32.

In relation to the circumference of the outer rotor 3, the blind pockets 21, 22, 23, 24 together exhibit an extent in the circumferential direction of the outer rotor 3 which corresponds to at least 20%, in particular at least 25%, of the circumference of the outer rotor 3, i.e. the blind pockets 21, 22, 23, 24 preferably overlap at least 20% of the outer circumference of the outer rotor 3, in particular at least 25% of the outer circumference of the outer rotor 3.

In relation to the outer diameter D of the outer rotor 3, the blind pockets 21, 22, 23, 24 exhibit a radial extent which preferably corresponds to at most 10% of the outer diameter D of the outer rotor 3, in particular at most 8% of the outer diameter D of the outer rotor 3.

As can be seen in particular from the blind pocket 24 in FIGS. 3 and 8, the outer rotor 3 extends axially beyond the blind pocket 24 towards its first end side 31 in its sliding contact. Preferably, the outer rotor 3 extends axially beyond each of the blind pockets 21, 22, 23, 24 towards its first end side 31 in its sliding contact. In accordance with the example embodiment, the outer rotor 3 extends further in the axial direction than the blind pockets 21, 22, 23, 24.

The circumferential bearing wall 2 also extends axially beyond the blind pocket 24 towards the first end side 31 of the outer rotor 3 in its sliding contact. Preferably, the circumferential bearing wall 2 extends axially beyond each of the blind pockets 21, 22, 23, 24 towards the first end side 31 of the outer rotor 3 in its sliding contact. As can be seen in particular in FIG. 3, the circumferential bearing wall 2 and the outer rotor 3 exhibit the same axial extent. The blind pocket 24, however, exhibits an axial extent which is smaller than the axial extent of the circumferential bearing wall 2 and outer rotor 3.

Because the outer rotor 3 and the circumferential bearing wall 2 extend axially beyond the blind pockets 21, 22, 23, 24 towards a first end side 31 of the outer rotor 3 in their sliding contact, the blind pockets 21, 22, 23, 24 terminate in a dead end in the region of the outer circumferential surface of the outer rotor 3 which is in sliding contact and/or in the region of the inner circumferential surface of the circumferential bearing wall 2 which is in sliding contact. The outer rotor 3 and the circumferential bearing wall 2 also form a radial sealing gap in the region of the first end side 31 of the outer rotor 3. The radial sealing gap is not breached by any of the blind pockets 21, 22, 23, 24. In this way, the blind pockets 21, 22, 23, 24 are fluidically separated from each other in the region of the first end side 31 of the outer rotor 3.

The blind pocket 24, preferably each of the blind pockets 21, 22, 23, 24, terminates axially in an opening on the circumferential bearing wall 2 in the region of the second end side 32 of the outer rotor 3, i.e. the blind pocket 24, preferably each of the blind pockets 21, 22, 23, 24, comprises a second end 24*b* of the pocket, which is formed with an opening, in the region of the second end side 32 of the outer rotor 3.

The outer rotor 3 and the circumferential bearing wall 2 do not extend axially beyond the blind pocket 24, preferably each of the blind pockets 21, 22, 23, 24, towards the second end side 32 of the outer rotor 3 in their sliding contact. The circumferential bearing wall 2 and the outer rotor 3 fluidically separate the blind pockets 21, 22, 23, 24 from each other at their end 24*b* which terminates in an opening, in their sliding contact between the individual blind pockets 21, 22, 23, 24.

The housing cover 12, which axially delineates the delivery chamber 5 on the second end side 32 of the outer rotor 3, rests against the circumferential bearing wall 2 in an axial sealing contact and forms an axial sealing gap with the circumferential bearing wall 2. The housing cover 12 rests against the outer rotor 3 in an axial sliding contact. In particular, the second end side 32 of the outer rotor 3 and the housing cover 12 exhibit an axial sealing gap. The housing cover 12 rests against the outer rotor 3 in an axial sliding contact, in particular an axial sealing contact, wherein the axial sealing gap between the housing cover 12 and the circumferential bearing wall 2 is smaller than the axial sealing gap between the housing cover 12 and the outer rotor 3.

The axial sealing gap between the housing cover 12 and the circumferential bearing wall 2 is formed over the entire circumference of the circumferential bearing wall 2 in the circumferential direction of the outer rotor 3. In this way, the blind pockets 21, 22, 23, 24 are fluidically separated from each other in the region of the second end side 32 of the outer rotor 3 by the circumferential bearing wall 2 and the housing cover 12.

The axial sealing gap between the housing cover 12 and the outer rotor 3 is formed over the entire circumference of the outer rotor 3 in the circumferential direction of the outer rotor 3. The axial sealing gap extends between the second end side 32 of the outer rotor 3 and the housing cover 12. In this way, the blind pockets 21, 22, 23, 24 are fluidically separated from each other in the region of the second end side 32 of the outer rotor 3. In particular, since the blind pockets 21, 22, 23, 24 comprise an end 24*b* which terminates in an opening in the region of the second end side 32 of the outer rotor 3, the blind pockets 21, 22, 23, 24 are fluidically separated from each other in the region of the second end 24*b* of the pocket by the axial sealing gap. In particular, the blind pockets 21, 22, 23, 24 are fluidically separated from each other by the axial sealing gap between the housing cover 12 and the circumferential bearing wall 2 and the axial sealing gap between the housing cover 12 and the outer rotor 3 in the region of the second end side 32 of the outer rotor 3.

Figure 5:
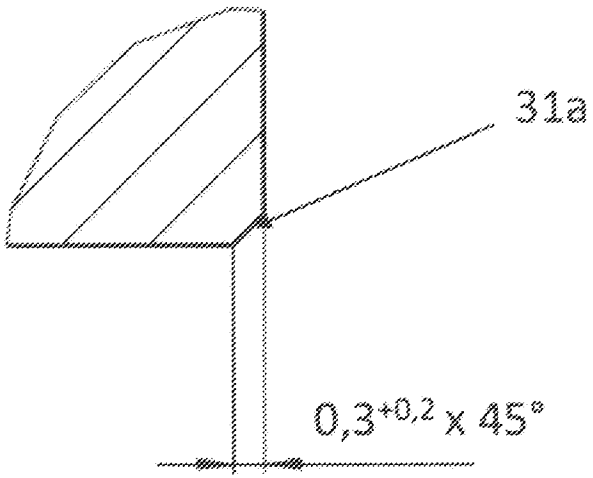
FIG. 5 a detailed view of the axial section from FIG. 4.
Figure 4:
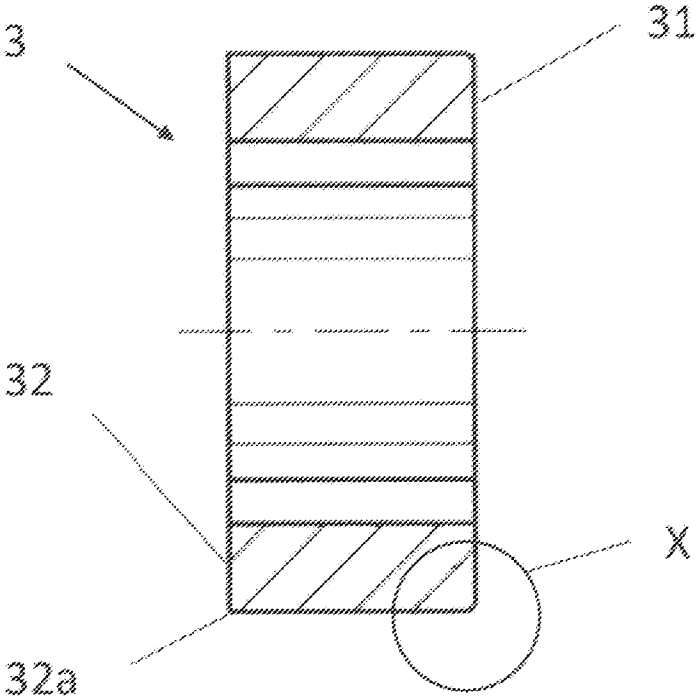
FIG. 4 an axial section through the outer rotor.

As shown in particular in FIGS. 4 and 5, the first end side 31 of the outer rotor 3 comprises a chamfer 31*a* along its circumferential outer periphery. As can be seen in particular from FIG. 5, the chamfer 31*a* is formed in accordance with the present example embodiment as a rotor bevel, wherein the rotor bevel preferably exhibits an angle of 45° and extends at least 300 μm in the radial and axial directions. In alternative embodiments, the rotor bevel can also exhibit a different angle, for example an angle of 60°. In particular, the first end side 31 of the outer rotor 3 does not comprise a sharp-edged transition between the first end side 31 and the outer circumferential surface along its circumferential outer periphery.

As disclosed in particular in FIG. 8, the circumferential bearing wall 2 comprises an inner edge transition 2*a* along its circumferential inner periphery on the first end side 31 of the outer rotor 3, i.e. on the axial side of the first end side 31 of the outer rotor 3. The inner edge transition 2*a* can be rounded, i.e. can exhibit a radius. In accordance with the example embodiment, the inner edge transition 2*a* is formed as an inner edge burr over the entire length of the circumferential inner periphery. The circumferential bearing wall 2 is formed in one piece with the end wall of the housing 1, in particular the housing cup 11, facing the first end side 31 of the outer rotor 3, and the inner edge transition 2*a* is formed along the inner edge between the end wall and the circumferential bearing wall 2.

The inner edge transition is preferably an inner edge burr which measures at least 300 μm in the radial and axial directions, wherein the inner edge burr exhibits an angle of 45° to the axial direction of the outer rotor 3.

When the outer rotor 3 is installed, the inner edge burr and the rotor bevel 31*a* mutually overlap, i.e. the inner edge burr is formed in accordance with the dimensions and angles of the rotor bevel, and/or the rotor bevel 31*a* is formed in accordance with the dimensions and angles of the inner edge burr. The outer rotor 3 preferably forms a sliding contact with the circumferential bearing wall 2 in the region of the rotor bevel 31*a*.

The second end side 32 of the outer rotor 3 does not comprise a chamfer or only comprises a small second chamfer 32*a*. The small second chamfer 32*a* extends at most 100 μm in the radial and axial directions. The outer circumferential edge 32*a* of the outer rotor 3 is preferably formed as a sharp edge on its second end side 32.

If the outer rotor 3 comprises a second small chamfer 32*a* on its outer circumferential edge of the second end side 32, said second small chamfer 32*a* corresponds to at most a third of the first chamfer 31*a*.

LIST OF REFERENCE SIGNS

1 housing
11 housing cup
12 housing cover
2 circumferential bearing wall
2*a* inner edge transition
21 blind pocket
22 blind pocket
23 blind pocket
24 blind pocket
24*a* first end of the pocket
24*b* second end of the pocket
3 outer rotor
31 first end side
31*a* first chamfer
32 second end side
32*a* second chamfer
4 inner rotor
5 delivery space
6 inlet
7 outlet
d inner diameter
D outer diameter
R3 pump rotational axis
R4 pump rotational axis of the inner rotor

The invention claimed is:

1. A rotary pump for delivering a fluid, the rotary pump comprising:

a housing featuring a delivery space which the housing surrounds and axially delineates on the end sides and which comprises an inlet for the fluid on a low-pressure side of the rotary pump and an outlet for the fluid on a high-pressure side of the rotary pump;

an inner rotor rotatable in the delivery space;

an outer rotor rotatable about a pump rotational axis in the delivery space and which forms delivery cells with the inner rotor; and a circumferential bearing wall which is formed by the housing or arranged in the housing and which surrounds the outer rotor and mounts it, such that it is rotatable about the pump rotational axis, in a radial sliding contact, wherein the rotary pump comprises one or both of (i) multiple blind pockets in the circumferential bearing wall which are radially open towards the outer rotor and (ii) multiple blind pockets in the outer rotor which are radially open towards the circumferential bearing wall, wherein the multiple blind pockets are fluidically separated from each other in the region of the radial sliding contact between the outer rotor and the circumferential bearing wall, wherein the rotary pump comprises one or both of (i) a chamfer on a first end side of the outer rotor along its circumferential outer periphery and (ii) an inner edge transition on the circumferential bearing wall along its circumferential inner periphery on the first end side of the outer rotor, and wherein the multiple blind pockets are arranged in an asymmetrical distribution over the circumference of the outer rotor in relation to the circumferential direction of the outer rotor.

2. The rotary pump according to the claim 1, wherein at least one of the outer rotor and the circumferential bearing wall extend(s) axially beyond at least one of the multiple blind pockets towards a first end side of the outer rotor in its/their sliding contact, such that a respective blind pocket terminates in a dead end at a first end of the blind pocket in the region of an outer circumferential surface of the outer rotor which is in sliding contact with or in the region of an inner circumferential surface of the circumferential bearing wall which is in sliding contact and is thus fluidically separated from the one or more blind pockets on the first end side of the outer rotor.

3. The rotary pump according to claim 2, wherein the outer rotor or the circumferential bearing wall extend(s) axially beyond each of the multiple blind pockets.

4. The rotary pump according to claim 1, wherein at least one of the multiple blind pockets terminates axially in an opening on the one or both of the circumferential bearing wall and the outer rotor on a second end side of the outer rotor.

5. The rotary pump according to the claim 4, wherein the one or both of the circumferential bearing wall and the outer rotor fluidically separate(s) the respective blind pocket from the one or more other blind pockets at their end which terminates in an opening, in its/their sliding contact.

6. The rotary pump according to claim 5, wherein at least one of the circumferential bearing wall and the outer rotor fluidically separate(s) each blind pocket from the one or more other blind pockets at their end which terminates in an opening, in its/their sliding contact.

7. The rotary pump according to claim 4, wherein each of the multiple blind pockets terminates axially in an opening on at least one of the circumferential bearing wall and the outer rotor on a second end side of the outer rotor.

8. The rotary pump according to claim 1, wherein the housing comprises a housing cover which axially delineates the delivery chamber on the second end side of the outer rotor, and wherein the housing cover rests against one or both of the circumferential bearing wall in an axial sealing contact and the outer rotor in an axially sealing sliding contact.

9. The rotary pump according to claim 1, wherein the housing comprises a housing cover which axially delineates the delivery chamber on the second end side of the outer rotor and forms an axial sealing gap with the circumferential bearing wall and the outer rotor, and wherein the axial sealing gap between the housing cover and the circumferential bearing wall is smaller than the axial sealing gap between the housing cover and the outer rotor.

10. The rotary pump according to claim 1, wherein the chamfer on the outer rotor overlaps with the inner edge transition on the circumferential bearing wall.

11. The rotary pump according to claim 1, wherein the second end side of the outer rotor comprises a second chamfer along its circumferential outer periphery, and the first chamfer is at least three or four times as large in the radial or axial direction as the second chamfer.

12. The rotary pump according to claim 1, wherein the first end side of the outer rotor comprises the chamfer along its circumferential outer periphery, and the chamfer measures at least 200 μm or at least 300 μm or at most 400 μm or 500 μm in the radial direction, or wherein the chamfer measures at least 200 μm or at least 300 μm or at most 400 μm or at most 500 μm in the axial direction.

13. The rotary pump according to claim 1, wherein the circumferential bearing wall does not comprise a chamfer or only comprises a small second chamfer along its circumferential inner periphery on the second end side of the outer rotor or the second end side of the outer rotor does not comprise a chamfer or only comprises a small second chamfer along its circumferential outer periphery.

14. The rotary pump according to claim 13, wherein the second end side of the outer rotor comprises a second chamfer along its circumferential outer periphery, and a first chamfer is at least three or four times as large in the radial or axial direction as the second chamfer.

15. The rotary pump according to claim 13, wherein the first end side of the outer rotor comprises a chamfer along its circumferential outer periphery, and the chamfer measures at least 200 μm or at least 300 μm or at most 400 μm or 500 μm in the radial direction, or wherein the chamfer measures at least 200 μm or at least 300 μm or at most 400 μm or at most 500 μm in the axial direction.

16. The rotary pump according to claim 1, wherein a respective blind pocket of the multiple blind pockets overlaps by more than 80% or more than 90% of its circumferential extent with either the inlet only or the outlet only.

17. The rotary pump according to claim 16, wherein the respective blind pocket overlaps by its entire circumferential extent with either the inlet only or the outlet only.

18. The rotary pump according to claim 1, wherein the rotary pump comprises four blind pockets, and the multiple blind pockets are arranged mirror-symmetrically in relation to an inner diameter of the circumferential bearing wall or an outer diameter of the outer rotor.

19. The rotary pump according to claim 1, wherein the multiple blind pockets extend at least twice as far or at least three times as far in the circumferential direction of the outer rotor as in the radial direction of the outer rotor.

20. The rotary pump according to claim 1, wherein an axial extent of at least one of the multiple blind pockets from a first end of the blind pocket up to a second end of the blind pocket corresponds to at least 70% or at least 80% of an axial extent of the outer rotor from a first end side up to a second end side.

21. The rotary pump according to claim 1, wherein the chamfer is a rotor bevel or wherein the inner edge transition is an inner edge burr.

22. A rotary pump for delivering a fluid, the rotary pump comprising:

a housing featuring a delivery space which the housing surrounds and axially delineates on the end sides and which comprises an inlet for the fluid on a low-pressure side of the rotary pump and an outlet for the fluid on a high-pressure side of the rotary pump;

an inner rotor rotatable in the delivery space;

an outer rotor rotatable about a pump rotational axis in the delivery space and which forms delivery cells with the inner rotor; and a circumferential bearing wall which is formed by the housing or arranged in the housing and which surrounds the outer rotor and mounts it, such that it is rotatable about the pump rotational axis, in a radial sliding contact, wherein the rotary pump comprises a multiple blind pockets on the circumferential bearing wall which are radially open towards the outer rotor, wherein the multiple blind pockets are fluidically separated from each other in the region of the radial sliding contact between the outer rotor and the circumferential bearing wall;

wherein each of the multiple blind pockets terminates axially in an opening on the one or both of the circumferential bearing wall and the outer rotor on a second end side of the outer rotor, and wherein the rotary pump comprises four blind pockets, wherein two of the blind pockets overlap by more than 80% or more than 90% of their circumferential extent with the inlet only, and the other two blind pockets overlap by more than 80% or more than 90% of their circumferential extent with the outlet only.

23. A rotary pump for delivering a fluid, the rotary pump comprising:

a housing featuring a delivery space which the housing surrounds and axially delineates on the end sides and which comprises an inlet for the fluid on a low-pressure side of the rotary pump and an outlet for the fluid on a high-pressure side of the rotary pump;

an inner rotor rotatable in the delivery space;

an outer rotor rotatable about a pump rotational axis in the delivery space and which forms delivery cells with the inner rotor; and a circumferential bearing wall which is formed by the housing or arranged in the housing and which surrounds the outer rotor and mounts it, such that it is rotatable about the pump rotational axis, in a radial sliding contact, wherein the rotary pump comprises one or both of (i) multiple blind pockets in the circumferential bearing wall which are radially open towards the outer rotor and (ii) multiple blind pockets in the outer rotor which are radially open towards the circumferential bearing wall, wherein the multiple blind pockets are fluidically separated from each other in the region of the radial sliding contact between the outer rotor and the circumferential bearing wall, and wherein at least one of the outer rotor and the circumferential bearing wall extend(s) axially beyond at least one of the multiple blind pockets towards a first end side of the outer rotor in its/their sliding contact, such that a respective blind pocket terminates in a dead end at a first end of the blind pocket in the region of an outer circumferential surface of the outer rotor which is in sliding contact with or in the region of an inner circumferential surface of the circumferential bearing wall which is in sliding contact and is thus fluidically separated from the one or more blind pockets on the first end side of the outer rotor, and wherein the multiple blind pockets are arranged in an asymmetrical distribution over the circumference of the outer rotor in relation to the circumferential direction of the outer rotor.

* * * * *